US005177831A

United States Patent [19]

Wirth

[11] Patent Number: 5,177,831

[45] Date of Patent: Jan. 12, 1993

[54] CLOTH-COVERED SPONGE MOP

[76] Inventor: David L. Wirth, 1217 Wickford Dr., Springfield, Ill. 62704

[21] Appl. No.: 702,944

[22] Filed: May 20, 1991

[51] Int. Cl.[5] ..... A47L 13/16

[52] U.S. Cl. ..... 15/244.3; 15/235; 15/247

[58] Field of Search ..... 15/244.1, 244.3, 244.2, 15/235, 247

[56] References Cited

U.S. PATENT DOCUMENTS

| | | | |
|---|---|---|---|
| 2,269,424 | 1/1942 | Bernstein | 15/247 X |
| 2,756,449 | 7/1956 | Dewey | 15/325 X |
| 4,015,306 | 4/1977 | Fenster | 15/209 R |
| 4,670,962 | 6/1987 | Giallourakis | 15/244.3 X |
| 4,823,427 | 4/1989 | Gibbs et al. | 15/247 |
| 4,858,267 | 8/1989 | Unger | 15/235 X |
| 4,945,599 | 8/1990 | Flynn | 15/244.3 |

FOREIGN PATENT DOCUMENTS

| | | | |
|---|---|---|---|
| 1252344 | 12/1960 | France | 15/247 |
| 1506482 | 11/1967 | France | 15/247 |

*Primary Examiner*—Chris K. Moore

*Attorney, Agent, or Firm*—Niro, Scavone, Haller & Niro

[57] ABSTRACT

A cloth covered sponge mop for cleaning, waxing polishing or drying a motor vehicle which includes a sponge element, a handle with a protective guard, a connecting plate for connecting the sponge element to the handle, and a fabric cover (made of materials such as natural or synthetic sheepskin, terry cloth, or chamois, depending on the activity) entirely enclosing the said sponge element and the connecting plate. The fabric cover element includes an insertion aperture and a closure element, such as Velcro®, for joining the periphery of the aperture and completely enclosing the sponge element and the connecting plate with non-metallic components.

8 Claims, 2 Drawing Sheets

Fig. 5
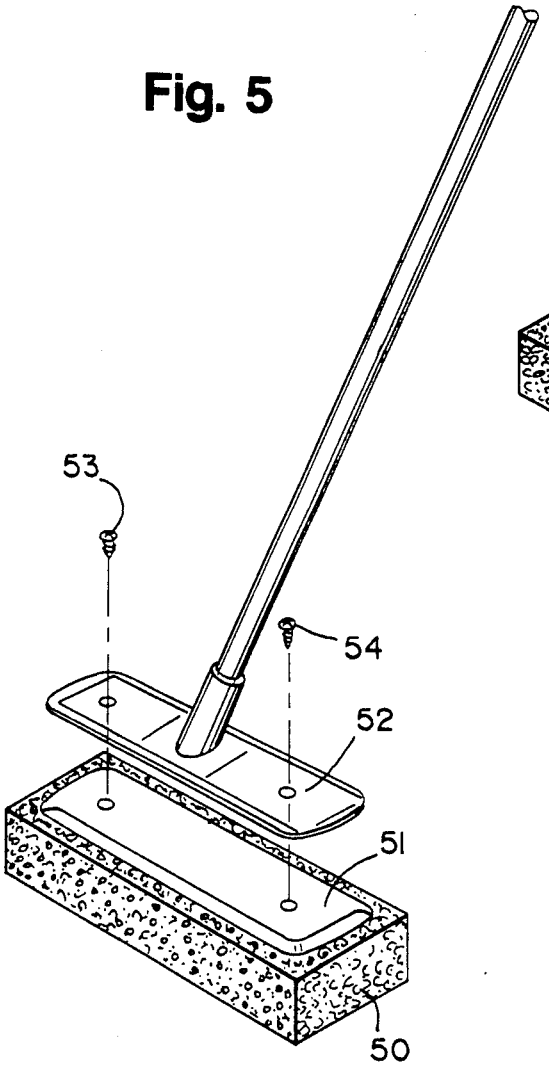
Fig. 6
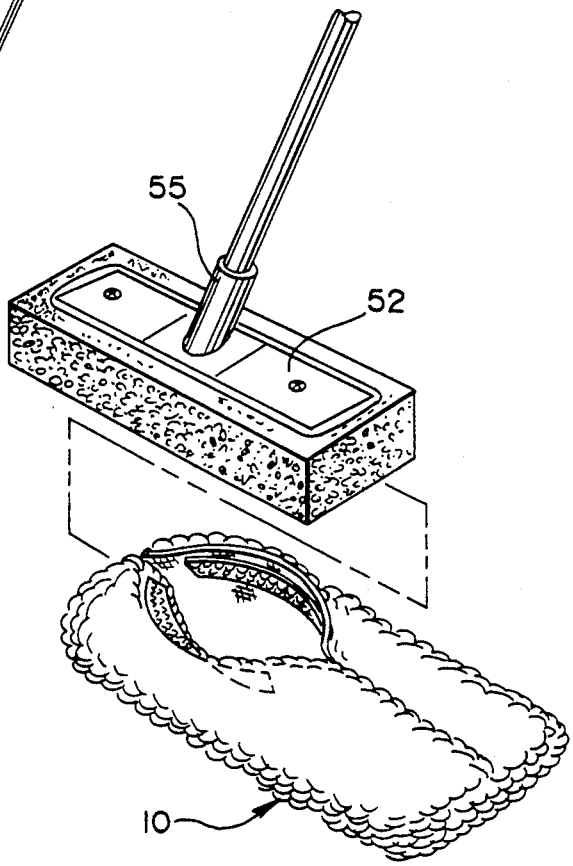
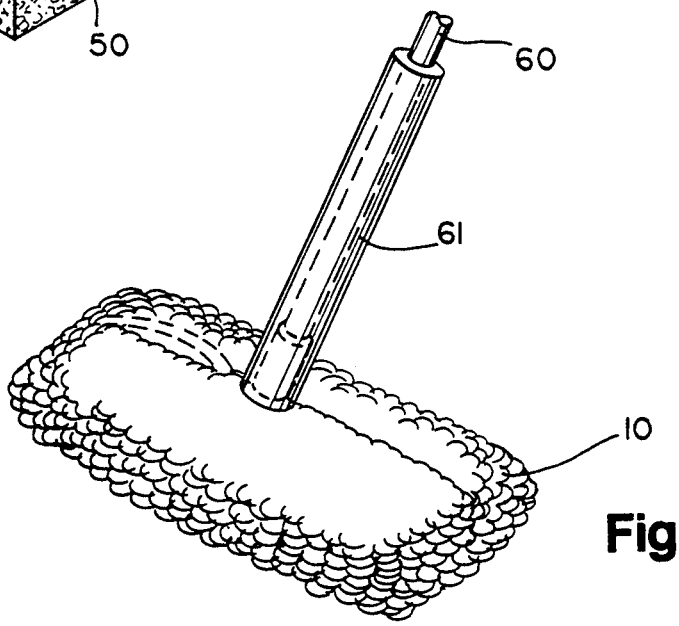
Fig. 7

CLOTH-COVERED SPONGE MOP

BACKGROUND OF THE INVENTION

The invention relates generally to mops and deals more specifically with improvements in sponge mops for washing, drying, waxing or polishing motor vehicles.

Hand-held sponges or brushes have been used to wash, dry, wax or polish floors. However, this practice has generally been replaced by the us of sponge mops which utilize a long handle attached to a sponge. These sponge mops eliminate the need to clean a floor on one's hands and knees as well as the need to get one's hands wet with the liquid used for cleaning. The cleaning task is also made easier because the long handle enables a small arm movement to be amplified, allowing the operator to cover a greater cleaning surface area.

The benefits which household sponge mops lend to floor cleaning may also be applied to motor vehicle washing, drying, waxing or polishing. Unfortunately, household sponge mops are ill-suited to motor vehicle washing. Many sponge mops have sharp, protruding surfaces, such as a sponge compression jaw or other type of mechanical linkage or device for expelling liquid from the sponge element. Also, the connecting plate which attaches to the sponge element often has peripheral edges which extend slightly past the periphery of the sponge element. Such sharp protrusions scratch a motor vehicle's paint finish. Household sponge mops also have a limited water holding capacity, which reduces their effectiveness for washing heavily soiled motor vehicle surfaces. In addition, dirt particles which become trapped in the sponge element may scratch the motor vehicle's paint finish as the sponge element is moved across the motor vehicle.

One prior art device used for motor vehicle washing includes a brush head connected to a hollow tube handle, and a garden hose fitting on the end opposite the brush. With this device, water from a garden hose travels through the hollow tube handle and exits through the brush head. However, due to the continuous and uncontrolled stream of water emanating from the brush head of this device, water is wasted. Moreover, the brush bristles can harm the vehicle's paint finish, as can accidental contact by the brush head with the vehicle. Furthermore, the weight and placement of the hose makes such devices awkward to use. Finally, such devices are useless in the absence of access to a continuous water source.

U.S. Pat. No. 4,945,599 to Flynn discloses another prior art device used for washing floors. However, the mechanical linkage disclosed in lever arm 25 would damage a paint finish if this device were used to wash motor vehicles. Further, because the terry cloth panel 27 does not enclose thumb nuts 24, these nuts, as well as uncovered attachment plate 20, can also damage a paint finish.

SUMMARY OF THE INVENTION

The present invention preserves the advantages of known automotive washing, drying, waxing or polishing (hereinafter summarized as "washing") devices. In addition, it provides new advantages not found in currently available devices and overcomes many of the disadvantages associated with the known devices. Accordingly, a sponge mop with a unique cloth sponge element cover is provided.

It is an object of the present invention to provide a device for washing motor vehicles having a covering consisting entirely of non-metallic components with no sharp protrusions which could scratch a vehicle's paint finish.

An additional object of the present invention is to provide a device for washing motor vehicles having a covering which, when dirty or worn, may be easily removed, cleaned and replaced.

Another object of the present invention is to provide a device for washing motor vehicles which has a soft cleaning surface to prevent damage to the vehicle's paint finish.

A further object of the present invention is to provide a device for washing motor vehicles which has a larger water capacity than standard household sponge mops.

Yet another object of the present invention is to provide a device for washing motor vehicles which conserves water.

Still another object of the present invention is to provide a device for washing motor vehicles which is easily manipulated and which does not require access to a continuous water source.

A still further object of the present invention is to provide a device for washing motor vehicles which does not waste water and which allows the user to easily reach the upper and lower surfaces of the vehicle.

BRIEF DESCRIPTION OF THE DRAWINGS

FIG. 5 is a perspective view of the invention in the absence of the sponge element cover and protective guard.

FIG. 6 is a perspective view of the sponge mop head and the opened sponge element cover.

FIG. 7 is a perspective view of one embodiment of the invention.

DETAILED DESCRIPTION OF THE PREFERRED EMBODIMENTS

FIGS. 1–4 demonstrate the manner in which the sponge element cloth cover or fabric covering element 10 of the present invention is constructed. This cloth cover 10 can be made from natural or synthetic sheepskin, or a blend thereof, which material is the preferred cover for washing. The preferred material for waxing or polishing is a terry cloth cover or other soft cotton or cotton-like material. For drying, the preferred material is natural or synthetic chamois.

Figure 1:
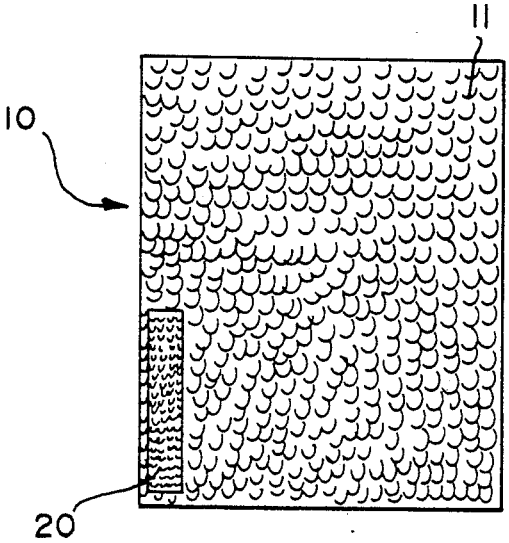
FIG. 1 is an overhead view of the outer surface of the sponge element cover before self-attachment.
Figure 2:
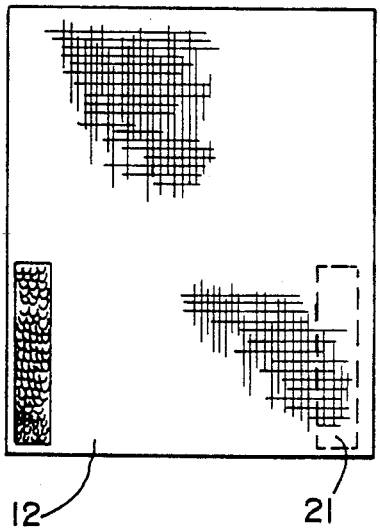
FIG. 2 is an overhead view of the inner surface of the sponge element cover before self-attachment.

FIG. 1 shows the cleaning surface 11 of rectangular cover sheet 10. A VELCRO® strip 20, or a strip made from a similar material that attaches in the same manner as VELCRO®, is located in the lower-left portion of cleaning surface 11. Alternatively, other fastening methods including, but not limited to, snaps, buttons, laces, zippers or hook and eye closures (hereinafter "closure means") can be used instead of a VELCRO® attaching strip 20. FIG. 2 shows the smooth, non-cleaning surface 12 of the reverse side of cover sheet 10. A second, receiving VELCRO® pad 21 is located in the lower-left portion of non-working surface 12.

Figure 3:
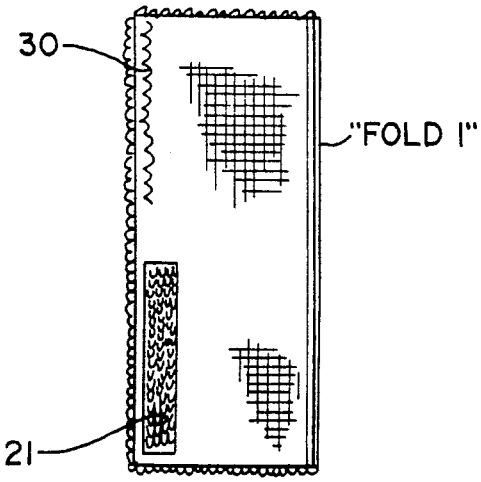
FIG. 3 is an overhead view of the sponge element cove after the initial stage of self-attachment.

The method of constructing the fabric covering element 10 of the present invention will now be particularly described. Looking now at FIG. 3, the cleaning surface 11 of cloth cover 10 has been folded in half along a vertical axis designated as "fold 1". Thus, the cleaning surface 11 is folded against itself, and non-cleaning surface 12 faces outward. After folding, a VELCRO® pad 21 or other closure means is positioned in the lower-left portion of cloth cover 10. The cloth cover 10 is now sewn together along a vertical line 30 from the upper-left corner of cloth cover 10 to a point about half-way down the cover, as shown in FIG. 3.

Figure 4:
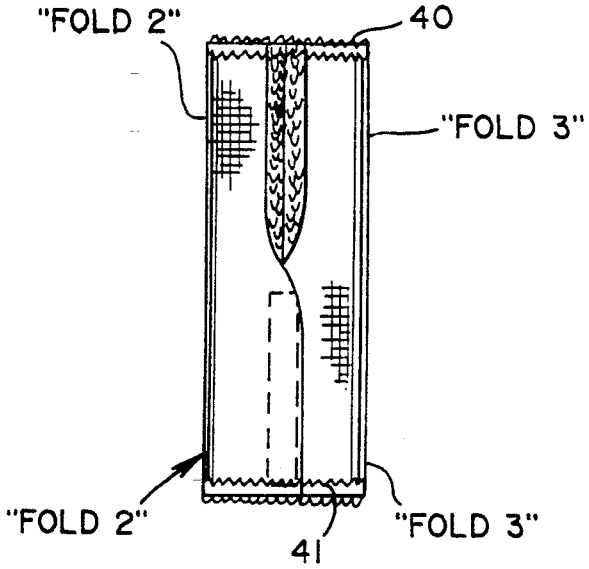
FIG. 4 is an overhead view of the sponge element cover after the final stage of self-attachment.

Cloth cover 10 is then repositioned by rotating it ninety degrees about fold 1 (shown in FIG. 3) and pressing down on the left edge (sewed line 30). This flattens out fold 1 and creates new folds, "fold 2" and "fold 3", shown in FIG. 4. Cloth cover 10 is now sewn in a horizontal direction along lines 40 and 41, as shown in FIG. 4. Cloth cover 10 is now fully assembled, and need only be turned inside-out prior to use.

FIG. 5 shows a perspective view of the partially assembled invention. A sponge element 50 is rigidly connected to a connecting plate 52 by screws 53 and 54 (the connecting plate and sponge element together forming the mop head), which affix connecting plate 52 to plastic plate 51, which is then glued to the upper portion of sponge element 50. Sponge element 50 is a standard sponge mop element made of nylon, cellulose, polyester or other construction. The connecting plate 52 is designed such that its peripheral edges are significantly less than the periphery of the sponge element 50. This eliminates the risk of the edges of the connecting plate 52 damaging the surface to be cleaned.

As shown in FIG. 5, a handle 60 is rigidly connected to connecting plate 52 by a hollow cylindrical projecting piece 55, which may be internally threaded or tapered. The handle 60 is a standard floor mop or broom handle of any desired length. It may be made of wood, steel or other construction, and may be telescoping to accommodate any desired length.

FIG. 6 shows one embodiment of the completed invention. Sheepskin cover 10 fits snugly and entirely over sponge element 50, plastic plate 51, connecting plate 52, and screws 53 and 54. The VELCRO® attaching strip 20 and receiving pad 21, secure the cover 10 over the mop head and ensures a snug fit. Alternatively, other closure means, including but not limited to those closure means mentioned above, may be used. Since the cover 10 surrounds the entire mop head, including the connecting plate 52, the possibility of contact between the motor vehicle and the hard connecting plate 52 is eliminated, thus avoiding any possibility of scratching the vehicle's paint finish.

The preferred embodiment of the present invention, as disclosed in FIGS. 6 and 7, includes a cloth cover 10 or fabric covering element 10 which, when secured to cover sponge element 50, includes an insertion aperture and closure elements (such as VELCRO® attaching strip 20 and receiving pad 21) which are asymmetrically located on the cover sheet 10 (i.e., the insertion aperture and closure elements are not centered with respect to sponge element 50 and handle 60).

For washing, the cloth is preferably made of a knitted synthetic fiber such as sheepskin, including either natural or synthetic sheepskin, or a combination thereof. Other preferred embodiments include acrylic, polyester, wool or a similarly composed pile, or any combination of said materials, with the pile being attached to an olefin or similar backing. Such a cover 10 provides a soft, resilient, liquid absorbing interface layer between the sponge element and the surface being washed. It has also been found that such covers retain large amounts of water, thereby decreasing the frequency with which the mop head must be dipped into a bucket or other water source. For waxing or polishing, the cover is preferably made of terry cloth or other soft cotton or cotton-like material. For drying, the cover is preferably made of a natural or synthetic moisture absorbing chamois.

FIG. 6 illustrates a protective guard 61, which surrounds the lower third of handle 60 and protects the motor vehicle's paint finish from scratching due to accidental contact by the handle 60. This protective guard may be constructed of closed cell foam or any other soft and resilient surface. A non-liquid permeable material with little or n liquid retaining capacity (to avoid wasting water and weighing down the handle) is preferred.

In washing motor vehicle, a standard household bucket is filled with water and a detergent suitable for cleaning automotive body finishes is added. The mop head with the cover in place is immersed into the bucket and agitated to ensure complete saturation with the cleaning solution. The mop head is removed from the bucket and moved back and forth with moderate pressure across the surface of the vehicle. The mop head is then returned to the bucket and agitated in the cleaning solution t release dirt particles. This process is repeated until the entire vehicle surface, including glass, bumpers, trim, wheels, tires, etc. has been washed. After washing, the vehicle may be rinsed by any standard technique, such as immersing the mop head in clean water and using the mop head to rinse the vehicle surface.

The present invention does not provide for a sponge compression jaw or other mechanical linkage device for expelling liquid from the sponge element 50. Such a device is not necessary to wash, wax or polish a motor vehicle and could easily scratch the vehicle paint finish if it accidentally contacted the vehicle's paint finish. For drying, a sponge compression device can be affixed to a bucket and used occasionally to expel collected water from the sponge element and cover.

In order to switch the washing mop into a waxing, polishing or drying mop, the sheepskin cover shown in FIG. 6 is simply removed and replaced with a terry cloth or chamois cover. Whenever a mop cover becomes dirty, it may be removed from the mop head and separately washed. If a mop cover becomes worn, it may be replaced without the purchase of a new mop or mop head. Similarly, the sponge element may be easily replaced as needed.

It is recognized that various minor modifications may be made in the structure of the invention without departing from its scope and, therefore, the specification is not intended to limit the invention to a precise form other than that described in the attached claims.

I claim:

1. A device for cleaning a motor vehicle with a liquid, comprising:

a compressive sponge element designed to selectively retain and release the liquid;

a handle;

a connecting plate rigidly connecting said sponge element to said handle;

a fabric covering element adapted to entirely enclose said sponge element and said connecting plate, said fabric covering element including an insertion aperture and closure elements for joining the periphery of said aperture for inserting said plate and said sponge element and completely enclosing said sponge element and said connecting plate with non-metallic components, said insertion aperture and said closure elements being asymmetrically located on said cover.

2. The device of claim 1 wherein said fabric covering element includes natural or synthetic sheepskin cloth, or a combination thereof.

3. The device of claim 1 wherein said fabric covering element includes a soft cotton or cotton-like material such as terry cloth.

4. The device of claim 1 wherein said fabric covering element is made of natural or synthetic chamois.

5. The device of claim 1 wherein said closure elements include Velcro® or a similar material.

6. The device of claim 1 further comprising a protective guard surrounding the lower portion of said handle.

7. The device of claim 6 wherein said protective guard is made of a soft, resilient and nonabsorbent material such as closed cell foam.

8. A method for providing an outer cover which includes a self-attaching mechanism for entirely enclosing a sponge element for use in cleaning motor vehicles, comprising the steps of:

(1) folding said rectangular fabric covering element in half;

(2) connecting a portion of the longer contiguous open edge of said fabric covering element;

(3) rotating said fabric covering element 90° around its longitudinal axis;

(4) flattening said fabric covering element by exerting a vertical force such that the amount of material on each side of said fabric covering element is equally displaced;

(5) connecting the shorter and oppositely facing contiguous open edges of said fabric covering element; and (6) turning said fabric covering element inside-out.

* * * * *